United States Patent [19]

Josefsson

[11] 4,431,045

[45] Feb. 14, 1984

[54] APPARATUS FOR PRESSURE TREATMENT OF A MOVING WEB

[76] Inventor: Lars G. Josefsson, 2786 Sechelt Dr., North Vancouver, British Columbia, Canada

[21] Appl. No.: 360,583

[22] Filed: Mar. 22, 1982

Related U.S. Application Data

[63] Continuation-in-part of Ser. No. 343,358, Jan. 27, 1982.

[51] Int. Cl.[3] ..... D21F 3/00; D21F 3/04

[52] U.S. Cl. ..... 162/358; 100/151; 100/153; 100/154; 162/205

[58] Field of Search ..... 100/153, 154, 151; 162/358, 360, 205

[56] References Cited

U.S. PATENT DOCUMENTS

| | | | |
|---|---|---|---|
| 3,093,535 | 6/1963 | Brauns et al. | 162/358 |
| 3,671,389 | 6/1972 | Wahlstrom et al. | 162/358 |
| 3,799,052 | 3/1974 | Kusters et al. | 162/205 |
| 3,808,096 | 4/1974 | Busker et al. | 162/205 |
| 3,973,483 | 8/1976 | Appenzeller | 162/360 |

FOREIGN PATENT DOCUMENTS

| | | | |
|---|---|---|---|
| 525788 | 6/1956 | Belgium | 162/358 |

*Primary Examiner*—Peter Chin
*Attorney, Agent, or Firm*—Carver & Co.

[57] ABSTRACT

An apparatus pressure treats a moving web by pressing the web against a surface. The apparatus comprises a continuous link chain and a chain support. The chain support supports a moving length of the chain close to the surface so the length of chain has a shape complementary to the shape of the surface. A length of web moving with the chain is pressed between the chain and the surface.

9 Claims, 13 Drawing Figures

APPARATUS FOR PRESSURE TREATMENT OF A MOVING WEB

RELATED APPLICATION

This application is a continuation-in-part of my copending U.S. patent application No. 343,358 filed Jan. 27, 1982.

BACKGROUND OF THE INVENTION

The invention relates to an apparatus for pressure treating a moving web by pressing a length of the web between a surface and a moving chain.

One example of the pressure treatment of a moving web is found in the nip press section of a paper making machine or a pulp machine. The continuous fiberous web is normally pressed between at least two closely spaced-apart press rolls. The pressure applied to the moving web by the rolls extracts water from the web. It has been recognized that a greater percentage of water can be extracted from the web by increasing the time during which the web is under pressure in the nip press section. There have been attempts to accomplish this by increasing the length of moving web which is under pressure and thereby the time available for drainage. In most cases, it has not been possible to reach more than 40% to 45% dryness. However, it is known that under static conditions paper webs can be pressed to over 70% dryness.

Attempts have been made to increase the nip width and thus the time under pressure by the use of softer rubber coverings on press rolls or otherwise deformable rolls. An example of this is found in U.S. Pat. No. 3,804,707 to Mohr et al. Such attempts have met with limited success due to the creation of sheer forces acting on the web on the ingoing and outgoing sides of nips.

Another approach is to replace one of the press rolls with a pressing device having a concave shape which is complementary to the cylindrical surface of the roll. Moving endless belts have been used to provide this complementary concave shape as seen for example in U.S. Pat. No. 3,808,096 to Busker which shows a figure eight-shaped cyliner press. Some means has normally been provided to press the belt against the press roll to give sufficient pressure on the web for the dewatering operation. In the Busker patent, for example, means is provided for delivering fluid under pressure to fill the belt loop. Fluid pressure chambers are applied in U.S. Pat. Nos. 4,173,249 to Holkko, 3,808,092 to Busker and 3,293,121 to Martin. The use of stationary backing members for applying pressure to such a belt is disclosed in U.S. Pat. No. 4,201,624 to Mohr. In U.S. Pat. No. 3,853,698 to Mohr, a pressure chamber is used.

Attempts to use belts for extended nip presses have not always been completely successful. U.S. Pat. No. 4,238,287 to Gill and U.S. Pat. No. 4,229,253 to Cronin disclose reinforced belts for extended nip presses.

U.S. Pat. No. 2,890,748 to Heinrich shows the use of a link chain belt for drainage in nip presses. However, Heinrich does not disclose the possibility of using chains to support a belt in an extended nip press or to provide the concave-shaped press member which has a shape complementary to that of the roll.

Other United States patents in the field include U.S. Pat. Nos. 3,325,351 to Orton, 3,528,883 to Lundin and 3,566,781 to Kunze.

Problems have been encountered with many prior art extended nip presses and so they have not been widely adopted. For example, there is inherent friction between stationary supports and the belt which leads to problems associated with resistance to the movement of the belt such as the heating thereof. Lubrication between the support shoe and the belt may be provided to ameliorate the situation. Reliability may be restricted in some systems using fluid support for the belt because of complexity and sealing problems. Accordingly, there is a need to provide improved or alternative support means for the web in an extended nip press.

SUMMARY OF THE INVENTION

According to the invention, an apparatus pressure treats a moving web by pressing the web against a surface. The apparatus comprises a continuous link chain and a chain support. The chain support supports a moving length of the chain close to the surface so the length of chain has a shape complementary to the shape of the surface. A length of web moving with the chain is pressed between the chain and the surface.

A moving belt may be received on the chain on a side thereof opposite the support. The belt moves with the chain over the support. The web is between the belt and the surface.

The surface may be a portion of the outside of a rotating roll. In this case, the portion of the support has a concave shape complementary to the shape of the outside of the roll.

The chain support may be plate-like with the chain guidably received on the periphery of the support. Alternatively, the support may have a peripheral track extending thereabout which guidably receives the chain.

In one form of the invention, the pressure exerting surface comprises another said apparatus. In this case, the portions of the supports supporting the chains are preferably flat.

The support may also be generally figure eight-shaped. The portion of the suppport in this case comprises a first concave-shaped portion on one side thereof. The support has a second concave-shaped portion on a side of the support opposite the first portion. The two concave-shaped portions are shaped to press the web tightly between the chain and first and second rolls respectively to form a two nip press.

Preferably, the portion of the support is shaped to receive a continuous belt and a continuous felt between the chain and the pressure exerting surface with the belt against the chain and the web between the felt and the surface.

The belts may have recesses on the outer side which faces the surface or roll for draining liquid from the pressed web. Alternatively, the belt may have a plurality of apertures for drainage.

The support may comprise a hollow, flexible member filled with a pressurized fluid. This member may be bag-like and of an elastomeric material. Preferably, a stationary, continuous belt extends about the hollow, flexible member. The chain is guidably received on the stationary, continuous belt.

An apparatus as described employing a continuous link chain offers a significant alternative for supporting a web in an extended nip press. While the chain may be employed alone in some applications to press the web against the surface, the web would normally be carried on one felt or between two felts in paper or pulp machines as it is pressed between the chain and the surface.

The belt may be grooved or perforated for drainage without unduly affecting its necessary strength or durability. The use of a moving chain, particularly in combination with a support having a shape which is complementary to the shape of the surface, means that the belt can be supported by simple and reliable mechanical means with relatively little friction. In fact, it is possible with the degree of support available with a continuous link chain and such a support to obviate the need for a press roll. Two such apparatuses may be spaced closely apart with the web pressed between the two apparatuses. In embodiments using pressurized fluid, the fluid may be contained within a bag-like member connected to an external source of pressurized fluid so no sealing problems arise as with some earlier apparatuses using pressurized fluid.

While apparatuses according to the invention may be used with new installations such as paper making machines, the apparatuses may be adapted for relatively easy installation on existing machines. This is particularly important for such industries as paper making where there are many existing machines and the replacement cost is extremely high.

DESCRIPTION OF THE PREFERRED EMBODIMENTS

Figure 5:
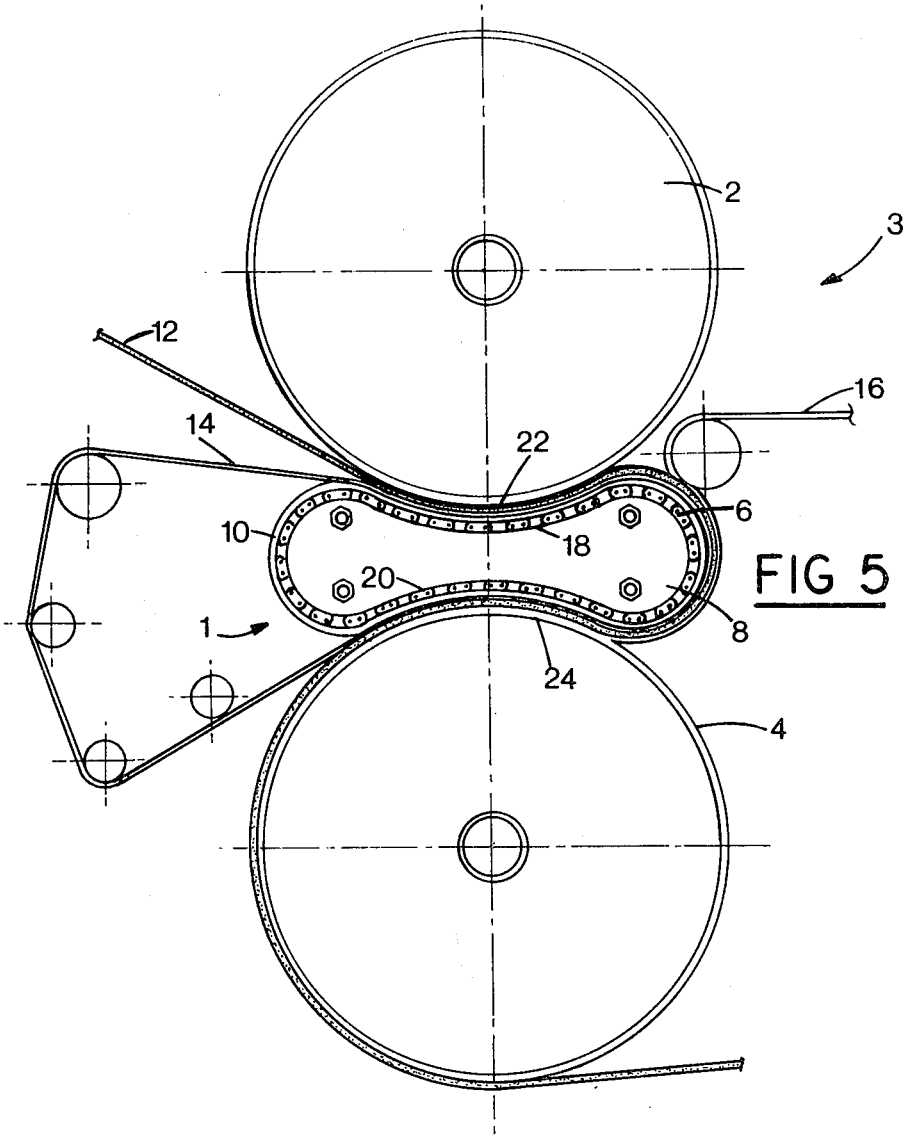
FIG. 5 is a simplified diagrammatic elevation of an apparatus according to a fourth embodiment of the invention used in a two nip press.

Referring to the drawings and FIG. 5 in particular, an apparatus 1 is shown as used for pressure treating a moving web, for example in a paper making machine 3, by pressing the web against a surface. In this case, two such surfaces are provided, namely the lower portion of an upper press roll 2 and the upper portion of a lower press roll 4. In a conventional nip press for a paper making machine, rolls 2 and 4 are pressed together and the web is pressed as it passes between the rolls while carried by a continuous felt. FIG. 5 however shows rolls 2 and 4 spaced apart vertically with apparatus 1 therebetween.

The apparatus 1 comprises a continuous link chain 6 which is supported by a chain support 8. A movable continuous belt 10 is received on the chain on a side thereof opposite the guide so the belt moves with the chain over the support. A web 12 moves with two continuous felts 14 and 16 and is pressed between the belt 10 and rolls 2 and 4. In some cases, one felt is used.

The support 8 is generally figure eight-shaped, having a first or upper concave-shaped portion 18 and a second or lower concave-shaped portion 20 on a side of the guide opposite portion 18. Portions 18 and 20 have complementary shapes to the outsides 22 and 24 of the rolls. These portions of the support are shaped to receive the two continuous felts 14 and 16 between the chain and the rolls with the belt between the chain and the web. The entire length of web between roll 2 and portion 18 of the support as well as the length of web between roll 4 and portion 20 of the support are tightly pressed for the extraction of water. The combination shown in FIG. 5 is an arrangement for a two nip press.

Figure 2:
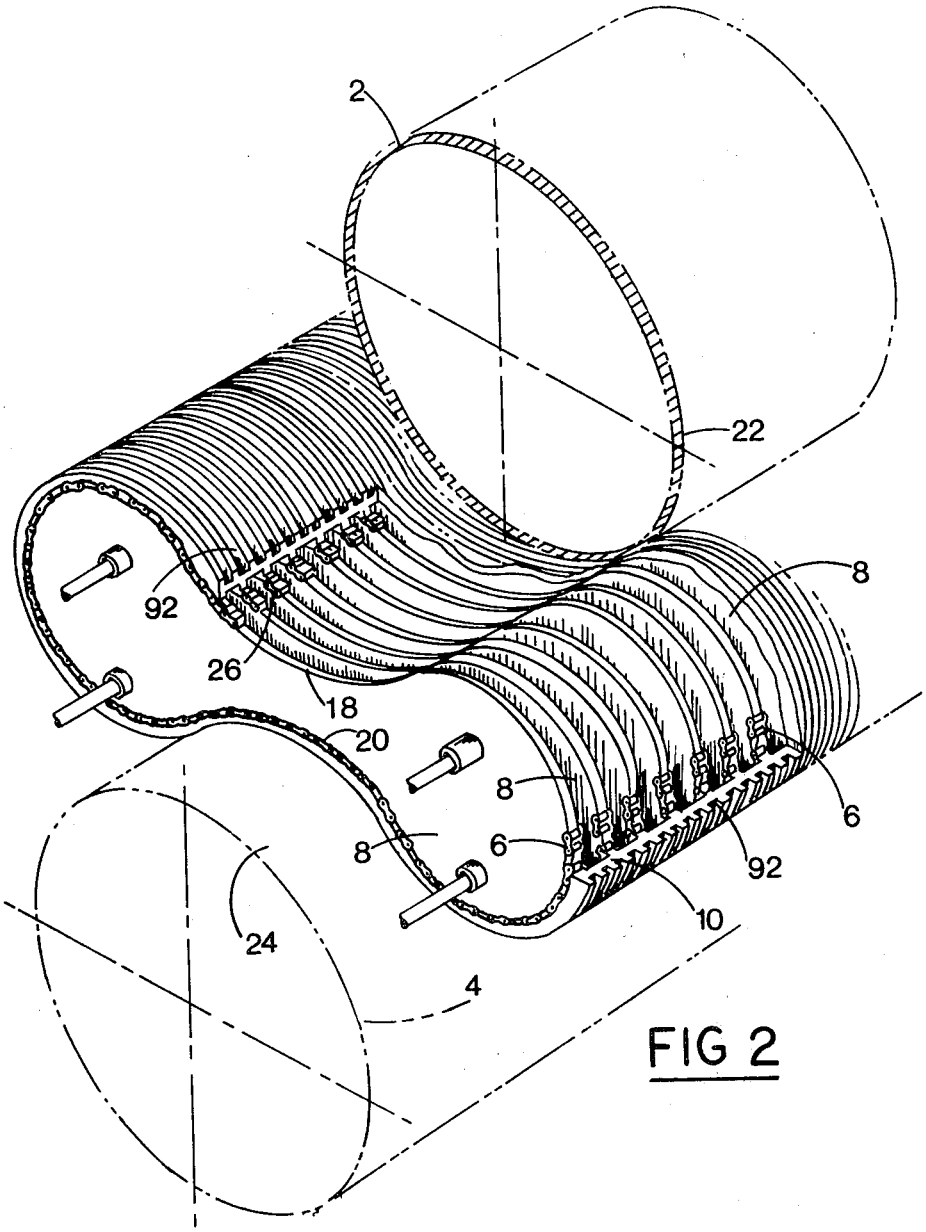
FIG. 2 is a perspective view of an apparatus according to a second embodiment of the invention with the top roll, the belt and continuous link chains partly broken away to show the chain supports.

Supports, chains and a belt similar to those in FIG. 5 are shown in better detail with reference to FIG. 2. A plurality of chains 6 and a plurality of supports 8 are used for extending across the width of the web and the press rolls or alternative surface.

Figure 3:
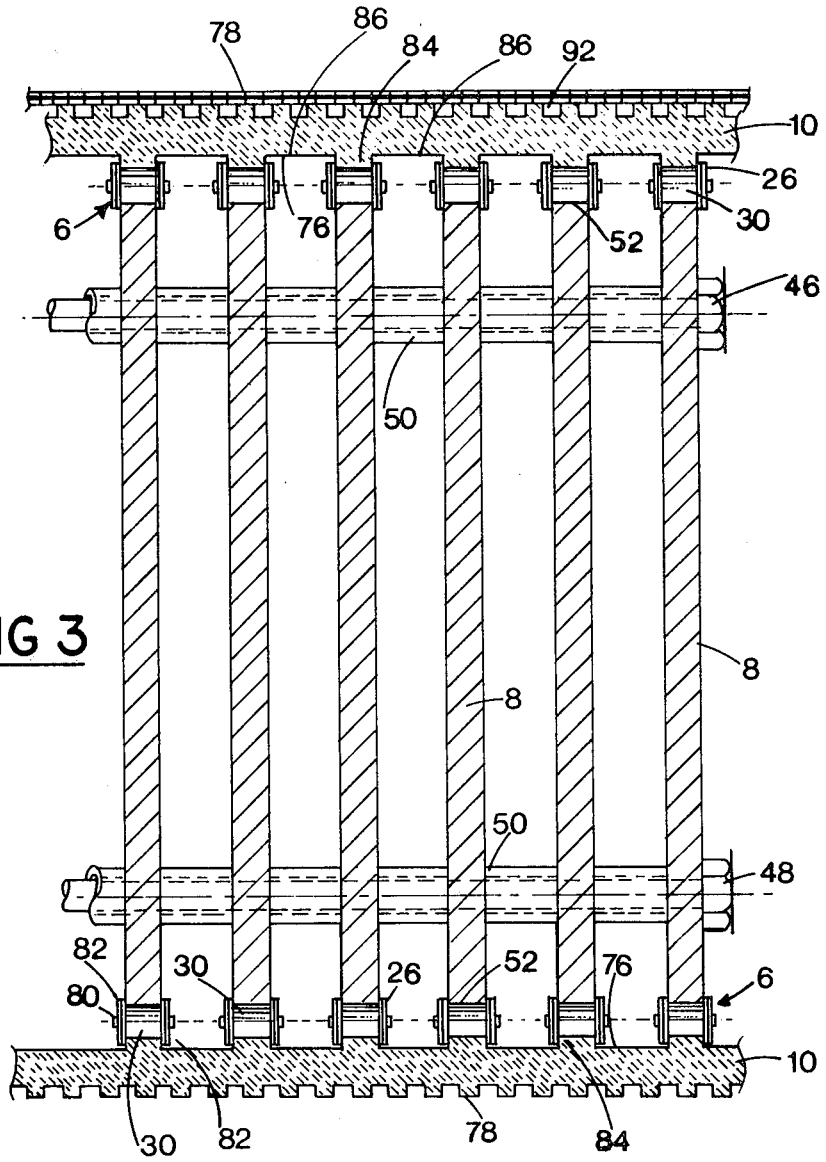
FIG. 3 is a sectional view through the belt, chains and supports of the embodiment of FIG. 2.

Each of the chains 6 comprises a plurality of links 26. Each of the rows of links has a row of longitudinally aligned rollers 30 shown in FIG. 3. The supports 8 are rigid and plate-like and form a set ganged together in parallel, spaced apart relationship by bolts 46 and 48 and spacers 50. The supports are located within the loops formed by the chains 6. The rollers of the chains are guidably received on the periphery 52 of each support as shown in FIG. 3. Instead of having a separate chain 6 for each support as shown in FIG. 3, each chain may have a plurality of laterally adjacent, ganged rows of links with one support for each longitudinally aligned row of rollers.

Figure 7:
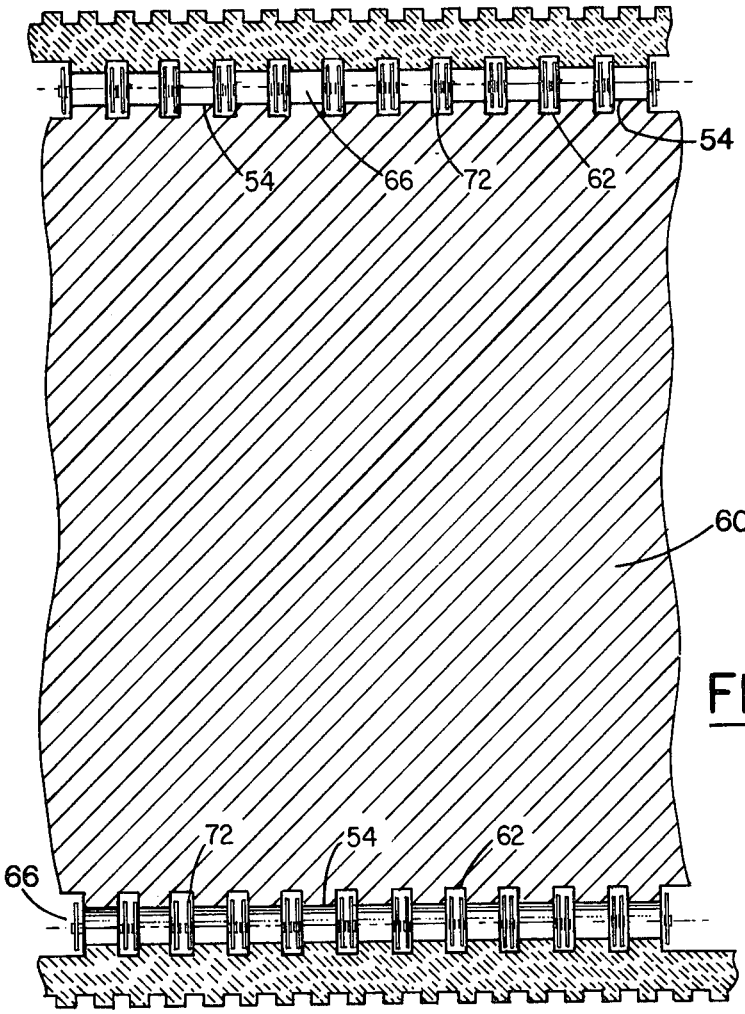
FIG. 7 is a sectional view through the chain and guide of an apparatus according to a sixth embodiment of the invention.

Referring to FIG. 7, instead of using separate plate-supports, guides, each support may comprise a plurality of peripheral guide tracks 54 which extend about a rigid support member 60. The guide tracks are separated by grooves 62. The rows of rollers 66 are guidably supported on the tracks while grooves 62 provide clearance for side bars 72 of the chains. The guide tracks may be of the same material and integral with the support member or may be inserts of a wear resistant material.

Belt 10 is suitably made of rubber or a flexible plastic. Polyurethane is used in the embodiment of FIGS. 2 and 3. It may be seen that the belt has an inner side 76 which is adjacent the chains 6 and an outer side 78 for facing the surface such as rolls 2 or 4. The roller chains 6 of FIG. 3 are standard in configuration, having the rollers 30 received on pins 80 between side bars 82. The side bars 82 project outwardly and inwardly beyond the rollers. As the rollers rotate about the periphery of the supports 8, it may be demonstrated that their peripheral velocity is twice the linear velocity of the side bars due to their rolling contact with the supports. Since the surface velocity of the rollers is not the same as the side bars, the belt must not contact both the rollers and the side bars. Accordingly, belt 6 is provided with a plurality of continuous parallel ridges 84 spaced apart by a plurality of grooves 86. The ridges 84 are of a size and spaced apart so they contact the rollers of the chains, while the grooves 86 provide clearance for the side bars.

Figure 11:
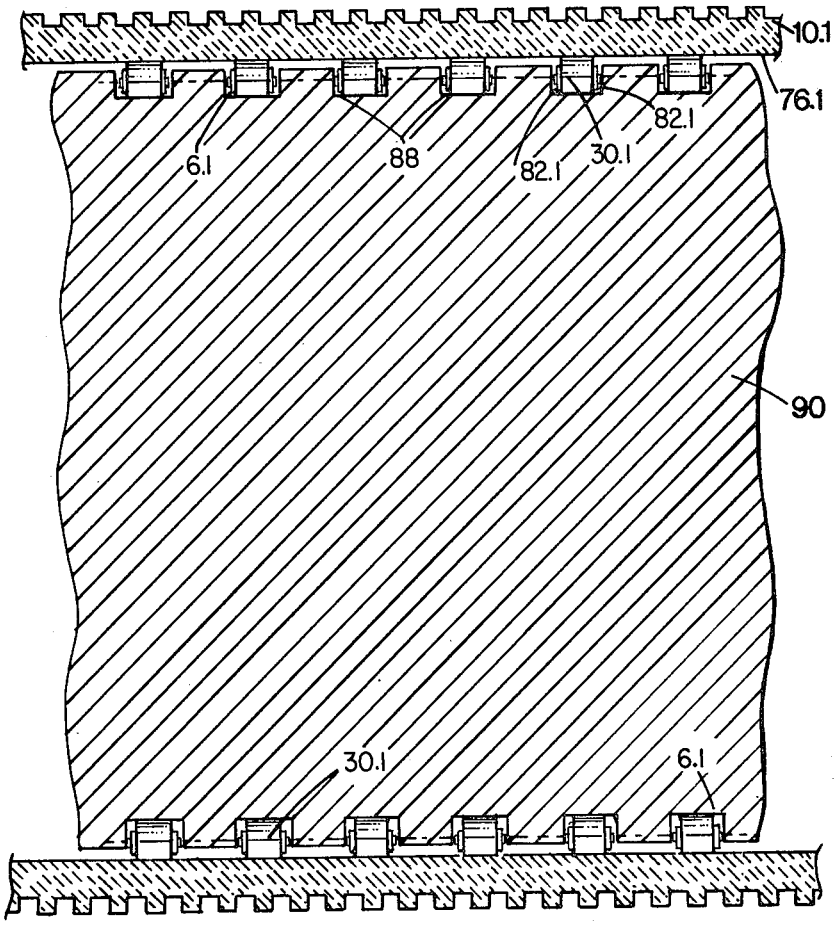
FIG. 11 is a sectional view of an apparatus according to a seventh embodiment of the invention.

Alternatively, instead of providing ridges on the inner side of the belt, an alternative belt 10.1 of FIG. 11 has a flat inner side 76.1. In order to accommodate such a belt, non-standard roller chains 6.1 are used where the rollers 30.1 are larger in diameter than usual so they project beyond the side bars 82.1. The supports comprise grooves 88 in a support member 90. A flat belt could also be used with the embodiment of FIG. 3 with the belt riding on the side bars instead of the rollers. The chain of FIG. 11 could also ride on a laterally flat support member without the grooves.

Figure 8:
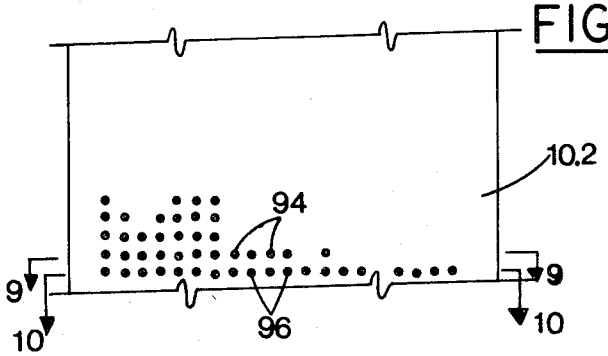
FIG. 8 is a plan view of an alternative belt.
Figure 9:
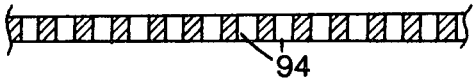
FIG. 9 is a sectional view along line 9—9 of FIG. 8 showing apertures extending through the belt.
Figure 10:
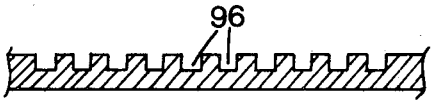
FIG. 10 is a sectional view along line 10—10 of FIG. 8 showing blind-drilled apertures.

Drainage of water from the web is improved when recesses are placed on the outer side 78 of the belt or apertures extend through the belt to the chain. In FIGS. 2 and 3, a plurality of continuous, parallel grooves 92 extend longitudinally on the outer side of the belt for drainage. Alternatively, FIG. 8 illustrates a belt 10.2 having a plurality of apertues 94 or 96 for drainage. As shown in FIG. 9, apertures 94 extend completely through the belt. Alternatively, as seen in FIG. 10, blind-drilled apertures 96 may be used.

Figure 6:
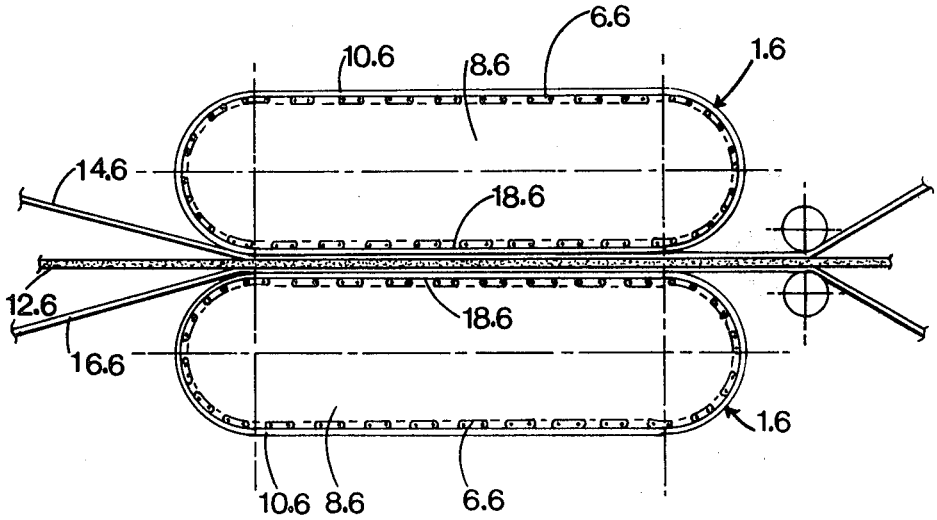
FIG. 6 is a simplified diagrammatic elevation of an apparatus according to a fifth embodiment of the invention.

FIG. 6 illustrates an embodiment where a pair of identical apparatuses 1.6 are used without a press roll. Apparatuses 1.6 are similar to the apparatus 1, having a roller chain 6.6 guidably received on a chain support 8.6 and with a belt 10.6 received on the chain for movement therewith. However, instead of the concave-shaped portions 18 and 20 of FIG. 3, each guide 8.6 has a single flat portion 18.6 which guidably supports a moving length of chain close to the surface comprising the other apparatus 1.6. Accordingly, web 12.6 between felts 14.6 and 16.6 is pressed between belts 10.6 of the two apparatuses 1.6 as the belts and chains 6.6 travel over the flat portions 18.6 of the guides.

Figure 1:
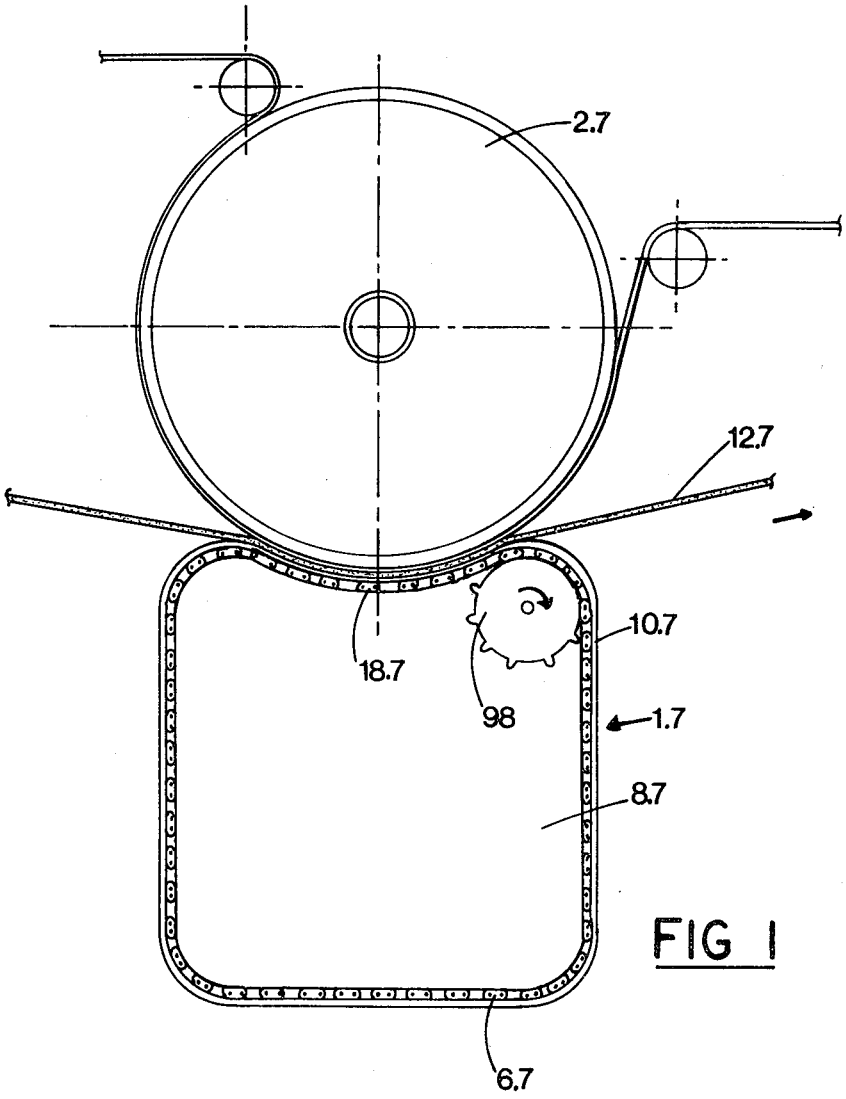
FIG. 1 is a simplified diagrammatic elevation of an apparatus for pressure treatment of a moving web according to a first embodiment of the invention.
Figure 4:
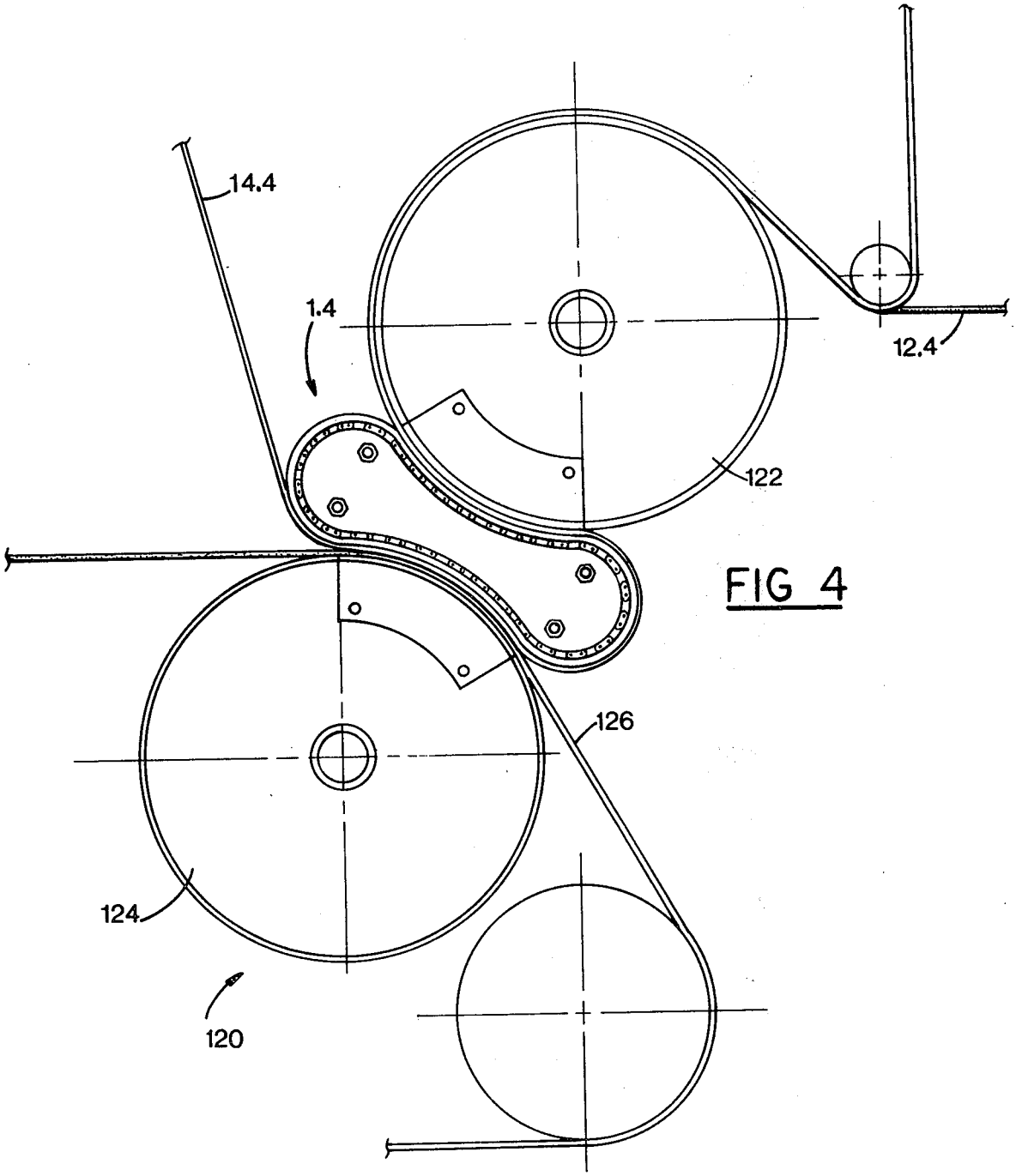
FIG. 4 is a simplified diagrammatic elevation of an apparatus according to a third embodiment of the invention used in the couch press section of a paper machine.

FIG. 1 shows another form of the invention which is generally similar to the embodiment of FIG. 4 with a press roll 2.7, and an apparatus 1.7 having a chain support 8.7, a chain 6.7 and a belt 10.7. The support has a concave portion 18.7 for supporting the chain close to the roll. This embodiment includes a drive sprocket 98 which provides means for driving the chain. Such drive means may be used in the other embodiments described above.

Besides the embodiments described above, many variations are within the scope of the invention. Belts can be made from composites or other materials having sufficient hardness to take up and distribute load without excessive deformation while being sufficiently flexible. Polyurethane of Durometer hardness in the range 80-85 and approximately one-quarter inch in thickness is suitable for some purposes.

Press felts should be of the open type and should remain open during pressure to provide the smallest resistance to water passage. Felts with built in plastic fabric are preferred. In embodiments similar to that of FIG. 5 using two rolls, one or both press rolls may be driven.

Figure 12:
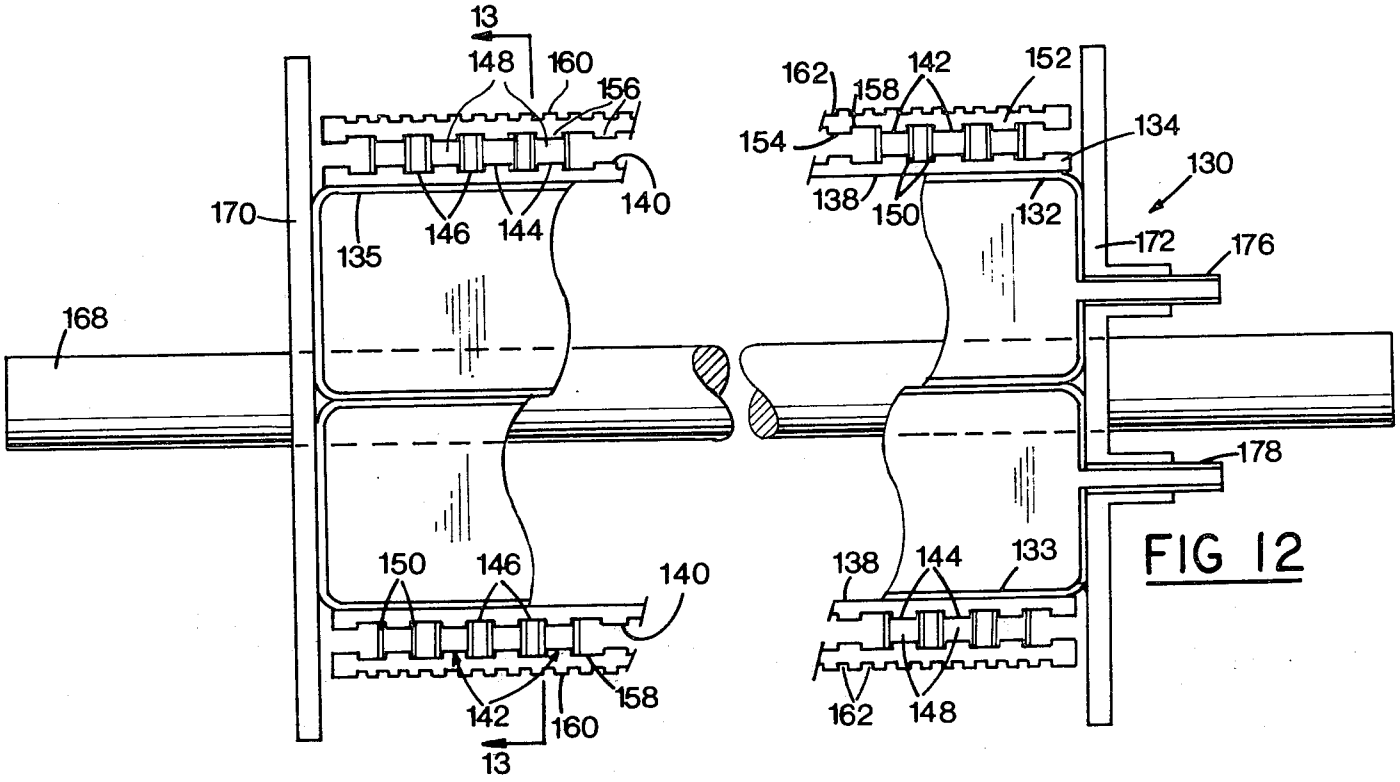
FIG. 12 is a fragmented transverse section of an apparatus according to an eighth embodiment of the invention.
Figure 13:
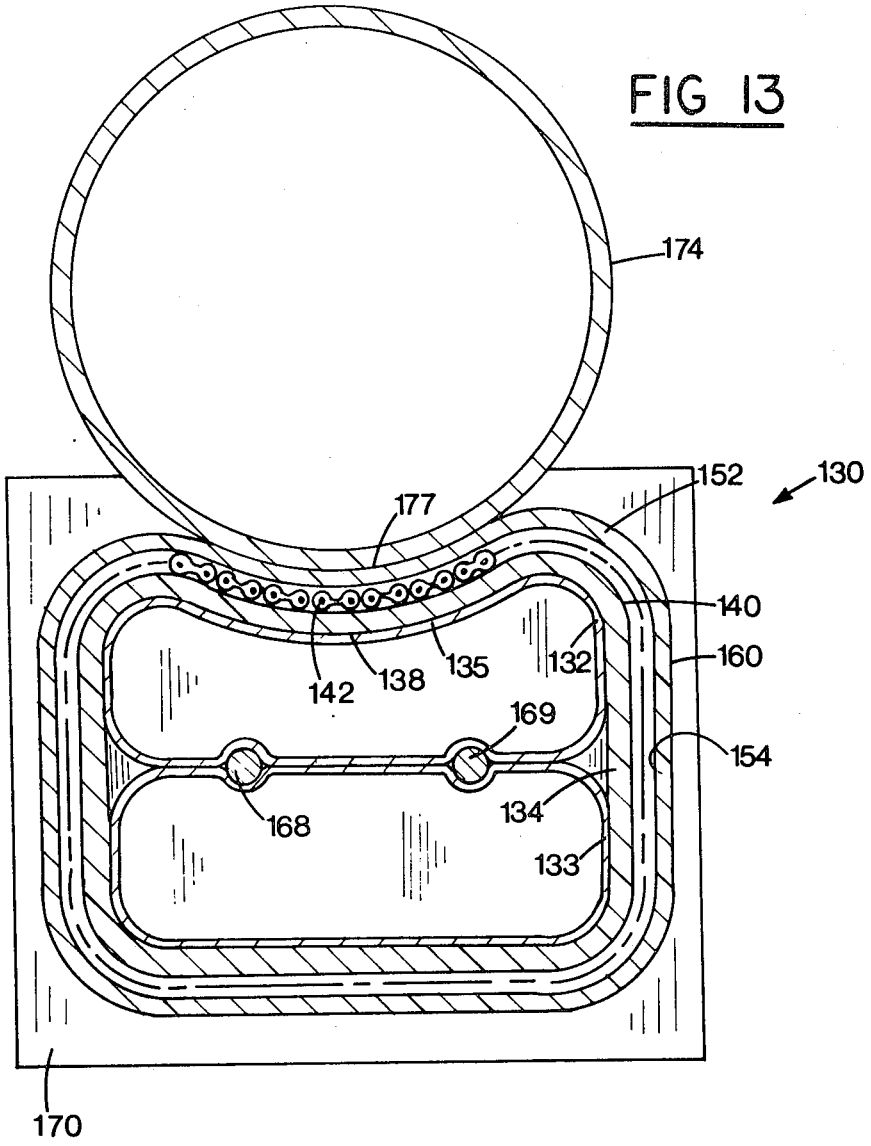
FIG. 13 is a longitudinal section along line 13—13 of FIG. 12.

FIGS. 12 and 13 show another apparatus 130 for pressure treating a moving web. This embodiment has a chain support which comprises two members 132 and 133 and a stationary, continuous belt 134.

In this case, the members 132 and 133 are hollow and baglike and are made of a flexible impervious material such as rubber, neoprene or another elastomeric material. The stationary continuous belt 134 extends over top portion 135 of member 132 and about the members 132 and 133 which are positioned one on top of the other. The belt is of such a size that it has a snug fit on the members. Inner side 138 of the belt adjacent the members 132 and 133 is flat. Outer side 140 of the belt is shaped to guidably receive a plurality of continuous roller chains 142. In this embodiment the belt has a plurality of continuous parallel ridges 144 which serve as peripheral guides, each receiving one of the chains 142. The ridges 144 are separated by grooves 146. The chains have rollers 148 which rotate along ridges 144 while grooves 146 provide clearance for side bars 150 of the chains.

A movable continuous belt 152 extends about the chains 142 for rotation about members 132 and 133. The belt 152 has an inner side 154 with a plurality of alternating ridges 156 and grooves 158. The ridges 156 allow the belt to ride on the rollers 148 only of chains 142 while the grooves 158 provide clearance for the side bars 150. The movable belt 152 has an outer side 160 with a plurality of spaced apart, parallel grooves 162. Grooves 162 provide drainage of liquid from a web being pressure treated.

The apparatus 130 has a pair of tie rods 168 and 169 which extend transversely between members 132 and 133. A pair of flat, plate-like lateral supports 170 and 172 are connected to opposite ends of the tie rods on each side of belt 134. These supports limit lateral expansion of the members 132 and 133. With reference to this embodiment, "lateral" dimensions are parallel to the longitudinal direction of the rods 168 and 169.

The members 132 and 133 are connected to conduits 176 and 178. These conduits provide means for connecting the members to an external source of pressurized fluid, either gaseous or liquid.

Variations of apparatus 130 are within the scope of the invention. For example, chains with rollers having larger diameters so they project beyond the side bars, such as chains 6.1 of FIG. 11 may be used. In this case the belt may have a flat inner side as belt 10.1 of FIG. 11. Instead of grooves 162, the belt may have apertures or blind-drilled holes for drainage as shown in FIG. 9 and FIG. 10, respectively. A single bag-like member could be used in place of two. In this case, the member could be generally annular with a tie rod passing through a central aperture. Alternatively, a plurality of such bag-like members could be arranged along the direction of travel of the web so pressure on the web could be varied as it travels through the extended nip press. Instead of bag-like members 132 and 133 as shown, a member with rigid sides could be used provided the member has a flexible portion equivalent to top portion 135 of member 132 which supports the chain and is conformable to roll 174 or other such surface.

In use the apparatus 132 is held against a surface which, in this case, is a roll 174. The roll may be, for example, a press roll of a nip press section of a paper making machine or a presser roll of a couch section of a paper making machine. The apparatus is pressed against the roll and the flexible members 132 and 133, in paticular top portion 135 of member 132, allow the apparatus to conform to the shape of the roll in a complementary manner. In FIG. 13, for example, the apparatus has a concavely curved top portion 177 with a radius of curvature approximately equal to the radius of the outside of roll 174. The nip length may be controlled by adjusting the pressure of fluid supplied to the members 132 and 133. In a paper making machine a moving felt carrying a web would be received between the belt 152 and the roll 174 and the top portion of the apparatus would be shaped to so receive the felt and web. The pressurized fluid within members 132 and 133 assures a constant pressure as the web passes between the belt 152 and the roll 174. The apparatus 130 may be supported against roll 174 by a structure connected to tie rods 168 and 169 and/or supports 170 and 172.

The apparatus 130 may be used with rolls of different diameters since it readily conforms to different shapes. For this reason a single example of the apparatus may be readily adapted for use with different existing paper making machines or other pressure treatment apparatuses. Two such apparatuses may be used without a roll in a manner similar to apparatuses 1.6 of FIG. 6. The portions of the apparatuses which oppose each other are essentially flat in this case.

What is claimed is:

1. An apparatus for pressure treating a body of continuously moving material, comprising:

a curved movable surface;

a movable flexible belt facing the movable surface and spaced a small distance therefrom so as to accommodate the moving material between the surface and the belt;

a continuous movable roller chain disposed behind and in contact with the belt for providing support thereto;

chain support means for supporting a moving length of the rolling chain in pressure contact with the belt in a shape complementary to the shape of the surface;

the support means including a flexible, bag-like member capable of receiving a fluid and being comformable to the shape of the surface, such that the length of material under simultaneous pressure engagement between the surface and the belt can be varied.

2. An apparatus as claimed in claim 1, wherein the member is of an impervious, elastomeric material.

3. An apparatus as claimed in claim 2, further comprising a stationary, continuous belt extending about the member, the chain being guidably received on the stationary, continuous belt.

4. An apparatus as claimed in claim 3, wherein the stationary, continuous belt is of polyurethane.

5. An apparatus as claimed in claim 3, wherein the stationary, continuous belt has a peripheral guide for guidably receiving the chain.

6. An apparatus as claimed in claim 3, further comprising lateral supports for the member on each side of the fixed continuous belt which limit lateral expansion of the hollow flexible member.

7. An apparatus as claimed in claim 6, the lateral supports being flat and plate-like.

8. An apparatus as claimed in claim 6, comprising two said members, the stationary, continuous belt extending about both said members and the tie rod extending between the members.

9. An apparatus as claimed in claim 2 or claim 3, further comprising a conduit connected to the member for supplying fluid to the member.

* * * * *